US010182960B2

(12) United States Patent
Jackson et al.

(10) Patent No.: US 10,182,960 B2
(45) Date of Patent: Jan. 22, 2019

(54) SENSORY UPRIGHT CHAIR FOR APPLYING DEEP TOUCH PRESSURE AND METHOD OF USE

(71) Applicant: The Sensory Chair Company, Inc., Overland Park, KS (US)

(72) Inventors: Stuart T. Jackson, Overland Park, KS (US); Keith E. Manbeck, Gardner, KS (US); Austin M. Edmondson, Overland Park, KS (US); Donald D. Pellen, III, Overland Park, KS (US); Zachary M. Naatz, Overland Park, KS (US); Christopher M. Beebe, Olathe, KS (US)

(73) Assignee: The Sensory Chair Company, Inc., Overland Park, KS (US)

( * ) Notice: Subject to any disclaimer, the term of this patent is extended or adjusted under 35 U.S.C. 154(b) by 503 days.

(21) Appl. No.: 14/958,636

(22) Filed: Dec. 3, 2015

(65) Prior Publication Data

US 2016/0158090 A1 Jun. 9, 2016

Related U.S. Application Data

(60) Provisional application No. 62/087,553, filed on Dec. 4, 2014.

(51) Int. Cl.

| | |
|---|---|
| ***A61H 9/00*** | (2006.01) |
| ***A47C 27/08*** | (2006.01) |
| ***A47C 7/02*** | (2006.01) |

(52) U.S. Cl.

CPC ..... *A61H 9/0078* (2013.01); *A47C 7/024* (2013.01); *A47C 27/082* (2013.01);
(Continued)

(58) Field of Classification Search

CPC .... A61H 2201/0149; A61H 2201/5071; A61H 2201/1238; A61H 2201/1633;
(Continued)

(56) References Cited

U.S. PATENT DOCUMENTS 2,053,538 A * 9/1936 Scott ..... B64D 25/04 297/445.1

3,148,391 A 9/1964 Whitney (Continued)

FOREIGN PATENT DOCUMENTS

| | | |
|---|---|---|
| WO | 4714434 | 12/1987 |
| WO | WO2014120084 | 8/2014 |

OTHER PUBLICATIONS

"International Search Report & Written Opinion; PCT/US2017/017976, dated Jun. 3, 2017".

*Primary Examiner* — Timothy Stanis

(74) *Attorney, Agent, or Firm* — Law Office of Mark Brown, LLC; Christopher M. DeBacker

(57) ABSTRACT

A sensory upright chair system to provide deep touch pressure to a person and method of use. The system includes a frame, a pump, a pair of inflatable air tubes, a pressure release valve, hoses and hardware, a pressure sensor, and a fabric cover. The pump and pressure sensor are connected to a power supply, and connected to the air tubes and pressure release valve via hoses and hardware. Switching on the power supply provides controlled inflation to the air tubes. A user sits in the chair between deflated air tubes. As the pressure in the air tubes increase, deep touch pressure is applied to the occupant's body where the air tubes contact the occupant. The fabric cover provides a comfortable barrier between the occupant and the air tubes. Deep touch pressure is thus applied to the occupant via contact with the tubes through the fabric cover.

7 Claims, 5 Drawing Sheets

(52) U.S. Cl.
CPC .... *A47C 27/083* (2013.01); *A61H 2201/0149* (2013.01); *A61H 2201/1238* (2013.01); *A61H 2201/1633* (2013.01); *A61H 2201/5071* (2013.01)

(58) Field of Classification Search
CPC ..... A61H 9/0078; A47C 4/54; A47C 27/082; A47C 27/083; A47C 7/024
USPC ..... 297/284.3, 284.6, 452.41
See application file for complete search history.

(56) References Cited

U.S. PATENT DOCUMENTS

| | | | | |
|---|---|---|---|---|
| 3,712,674 | A | 1/1973 | Ando | |
| 4,714,434 | A | 12/1987 | Norden | |
| 4,840,425 | A | 6/1989 | Noble | |
| 5,149,172 | A * | 9/1992 | Davis | A47C 4/54 297/256.11 |
| 5,636,900 | A * | 6/1997 | Wilkie | A61G 5/00 297/284.3 |
| 5,658,050 | A | 8/1997 | Lorbiecki | |
| 5,699,570 | A | 12/1997 | Wilkinson | |
| 5,797,155 | A | 8/1998 | Maier et al. | |
| 5,848,982 | A | 12/1998 | Hoshino et al. | |
| 6,171,270 | B1 | 1/2001 | Gau | |
| 6,179,383 | B1 * | 1/2001 | Ochi | A47C 4/54 297/250.1 |
| 7,261,380 | B2 * | 8/2007 | Ha | A61H 1/006 297/219.1 |
| 7,264,601 | B2 | 9/2007 | Liao | |
| 7,717,869 | B2 | 5/2010 | Eischen | |
| 8,827,371 | B2 | 9/2014 | Brncick et al. | |
| 2006/0258964 | A1 | 11/2006 | Biondo et al. | |
| 2008/0071200 | A1 | 3/2008 | Rawl-Meehan | |
| 2008/0243040 | A1 | 10/2008 | Kuwabara et al. | |
| 2009/0177130 | A1 | 7/2009 | Wegher-Thompson | |
| 2010/0137764 | A1 | 6/2010 | Eddy | |
| 2010/0145245 | A1 | 6/2010 | Chen | |
| 2010/0198120 | A1 | 8/2010 | Tago et al. | |
| 2010/0198121 | A1 | 8/2010 | Tago et al. | |
| 2013/0231596 | A1 | 9/2013 | Hornbach et al. | |
| 2013/0284274 | A1 | 10/2013 | Chaffee | |
| 2014/0031609 | A1 * | 1/2014 | Ballard | A61M 21/02 600/27 |
| 2014/0109319 | A1 | 4/2014 | Wilkinson | |
| 2014/0167463 | A1 | 7/2014 | Sakata et al. | |
| 2014/0346833 | A1 | 11/2014 | Magda et al. | |
| 2015/0040326 | A1 | 2/2015 | Fairburn et al. | |
| 2016/0158089 | A1 | 6/2016 | Jackson et al. | |
| 2016/0158090 | A1 | 6/2016 | Jackson et al. | |
| 2016/0199248 | A1 | 7/2016 | Jackson et al. | |
| 2017/0000685 | A1 | 1/2017 | Rohr et al. | |

* cited by examiner

SENSORY UPRIGHT CHAIR FOR APPLYING DEEP TOUCH PRESSURE AND METHOD OF USE

CROSS-REFERENCE TO RELATED APPLICATION

This application claims priority in U.S. Provisional Patent Application No. 62/087,553 filed Dec. 4, 2014, which is incorporated herein by reference.

BACKGROUND OF THE INVENTION

1. Field of the Invention

The present invention relates generally to sensory furniture, and more specifically to a sensory upright chair that applies deep touch pressure to a person's body, and the method to manufacture and use the same. Such furniture can be used in, but is not limited to, the treatment of neurodevelopmental disorders such as sensory processing disorder, autism, and other neurological, neuropsychological and physical conditions.

2. Description of the Related Art

Deep touch pressure is a form of tactile sensory input, often provided by firm holding, firm stroking, hugging, swaddling, and squeezing. A non-invasive and easily applied therapeutic method, deep touch pressure generally provides a calming effect for the recipient. A growing body of literature shows that deep touch pressure is helpful for managing anxiety and reducing maladaptive behaviors in people with cognitive developmental disorders, sensory processing disorder, psychological disorders, and certain other neurological and physical conditions. Research also shows that deep touch pressure can improve the quality of life for people experiencing anxiety, pain and unrest Several devices have been designed and developed to provide continuous deep touch pressure. Such devices include weighted blankets, therapy vests and other sensory based interventions which provide relatively low amounts of pressure. In the past, deep touch pressure machines have been developed to provide pressure to persons exhibiting oversensitivity to human touch. One such machine developed by Krauss (1987) was designed as having two air mattresses surrounded by a canvas wrap which was connected to a pulley. A person would lie between the two mattresses and pull on the rope connected to the pulley to increase the pressure exerted on them. Krauss, Am. J. Occup. Ther., *The Effects of Deep Pressure on Anxiety,* 41:366-373 (1987). Another such machine that has been widely used is the squeeze machine developed by Temple Grandin. The squeeze machine provided increased pressure compared to the Krauss device. The squeeze machine included two padded side boards hinged at the bottom to form a "V" shape, similar to a cattle squeeze chute. A lever-operated pneumatic valve is connected to an air cylinder that pulls the boards together. The lever allows the user to regulate the amount of pressure applied. Grandin, J. Child Adolescent Psychopharmacology, *Calming Effects of Deep Touch Pressure in Patients with Autistic Disorder, College Students, and Animals,* 2(1): 63-72 (1992). While these devices accomplish the task of providing deep touch pressure, there remained a need for a practical, lightweight, quiet device that provided variable deep touch pressure consistent with the needs of a user.

A sensory treatment device system known as the Sensory Lounger disclosed in U.S. patent application Ser. No. 14/816,907 (the "'907 application") filed Aug. 3, 2015, which is owned by the same entity as the present application and is incorporated herein by reference, was developed to provide deep touch pressure to a person in a comfortable manner, adaptable to persons of varying shapes and sizes, in which the person lay down between two air tubes which were subsequently inflated to provide deep touch pressure.

While the Sensory Lounger system disclosed in the '907 application provided deep touch pressure to a person lying down in an inclined position between the two air tubes, the present invention is an upright version of the system which allows a person to sit up while receiving deep touch pressure.

Heretofore there has not been available a sensory treatment device with the advantages and features of the present invention.

SUMMARY OF THE INVENTION

The present invention generally provides an upright sensory chair system and method of use and method of manufacture. The system generally includes a frame, a pump, air hoses connecting the pump to a pair of inflatable air tubes, a pressure release valve, piping and hardware or hoses and hardware, a pressure sensor, and a fabric cover.

In a preferred embodiment, called the Sensory Upright, the pump and pressure sensor are connected to a power supply. An on/off switch controls the electrical current to the pump. When this is switched on and the pressure release valve is in the closed position, the pump will start to inflate the tubes. The tubes will continue to inflate until the pressure sensor reaches a certain upper pre-set limit, at which point the pump will switch off. An optional check valve can be inserted into the system to maintain the pressure, however, the most common configuration is to not include the check valve and allow the system to slowly deflate. This continues until a lower pre-set limit is reached, at which point, the pump switches back on, and the air tubes inflate until the system once again reaches the upper pre-set pressure limit and the pump switches back off. The pre-set pressure range (the difference between the upper and lower preset limits) is usually around 0.1 psi, but can be adjusted according to an occupant's preferences. To quickly deflate the air tubes, the release valve is switched to the open position.

When an occupant first sits in the Sensory Upright, the fabric cover provides a comfortable barrier between the occupant and the air tubes, which initially are usually deflated or less than fully inflated. With the pressure release valve in the closed position and the pump switched on, the air tubes begin to inflate around the occupant, conforming to the occupant's body. As the pressure in the air tubes increase, deep touch pressure is applied to the occupant's body in the places where the air tubes are in contact with the occupant. When the pressure in the tubes reaches the upper pre-set limit, the pump switches off. If the occupant shifts position such that the pressure in the tubes drops below the lower pre-set limit, the pump switches back on until the pressure once again reaches the upper pre-set limit. Deep touch pressure is thus applied to the occupant via contact with the tubes through the fabric cover. The level of deep touch pressure is maintained through the pressure sensor between the pre-set pressure range, but can be quickly released by opening the pressure release valve. Different levels of deep touch pressure can be achieved by adjusting the pre-set upper and lower pressure limits on the pressure sensor, or by making course pressure adjustments by opening and closing the pressure release valve.

A alternative embodiment mechanical version of the pump and pressure sensor system may be provided by replacing the electrical powered pump with a mechanical pump such as a bellows foot pump or hand pump, and by replacing the pressure sensor with a pressure limiting valve, with an adjustable set-point. This set-point is set to a pressure point similar to the upper pre-set limit in the electrical version of this system. In the mechanical version the mechanical pump is used to inflate the tubes, and the pressure can be increased until it reaches the set-point of the pressure limiting valve.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
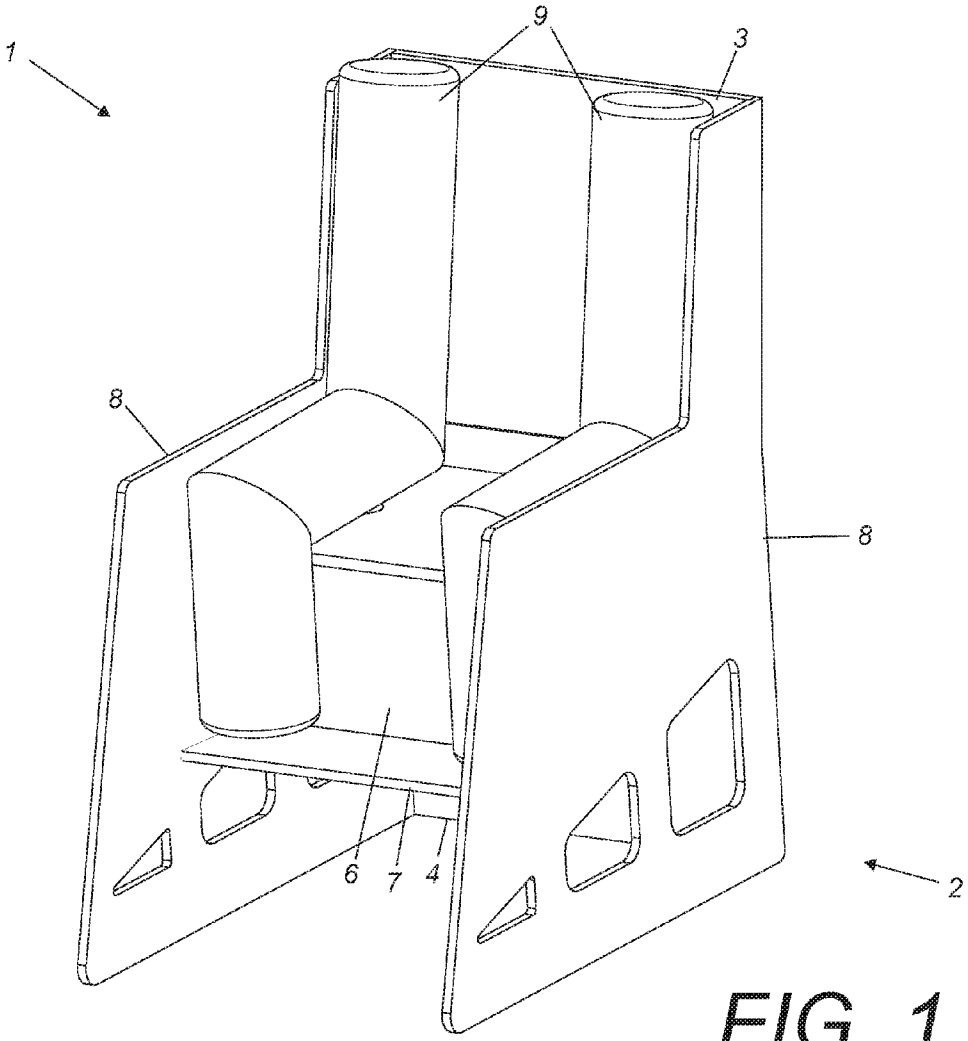
FIG. 1 is an isometric view of a preferred embodiment of the present invention in a fully assembled state.
Figure 2:
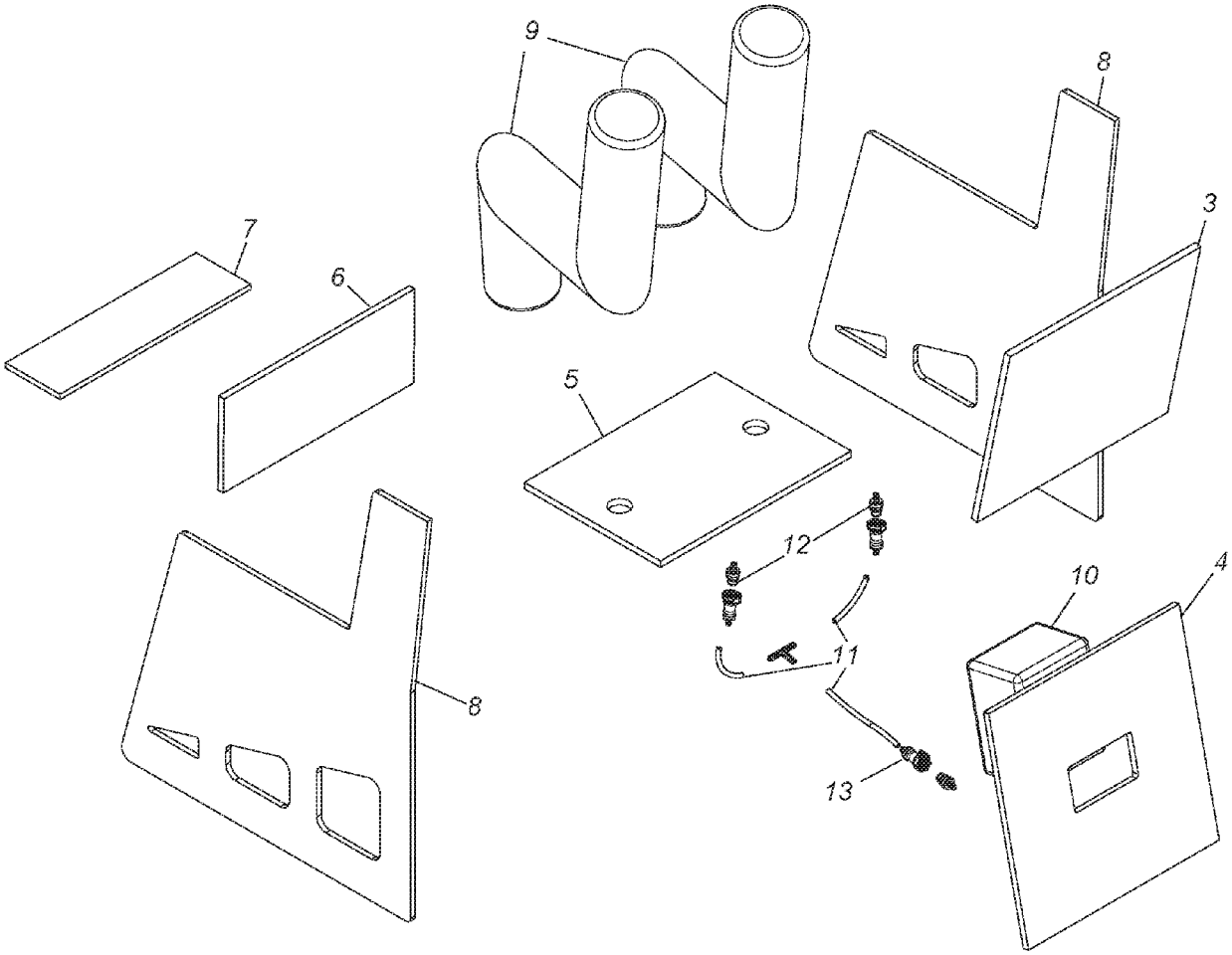
FIG. 2 is an isometric exploded view thereof.
Figure 3:
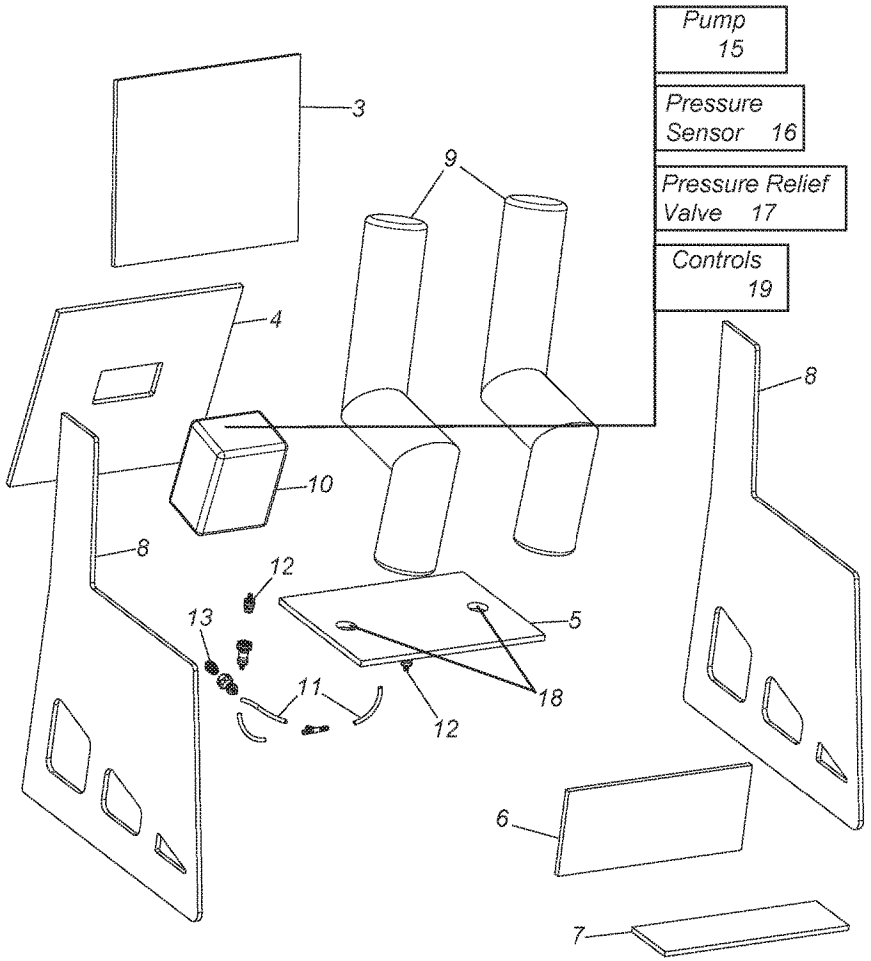
FIG. 3 is another isometric exploded view thereof.
Figure 4:
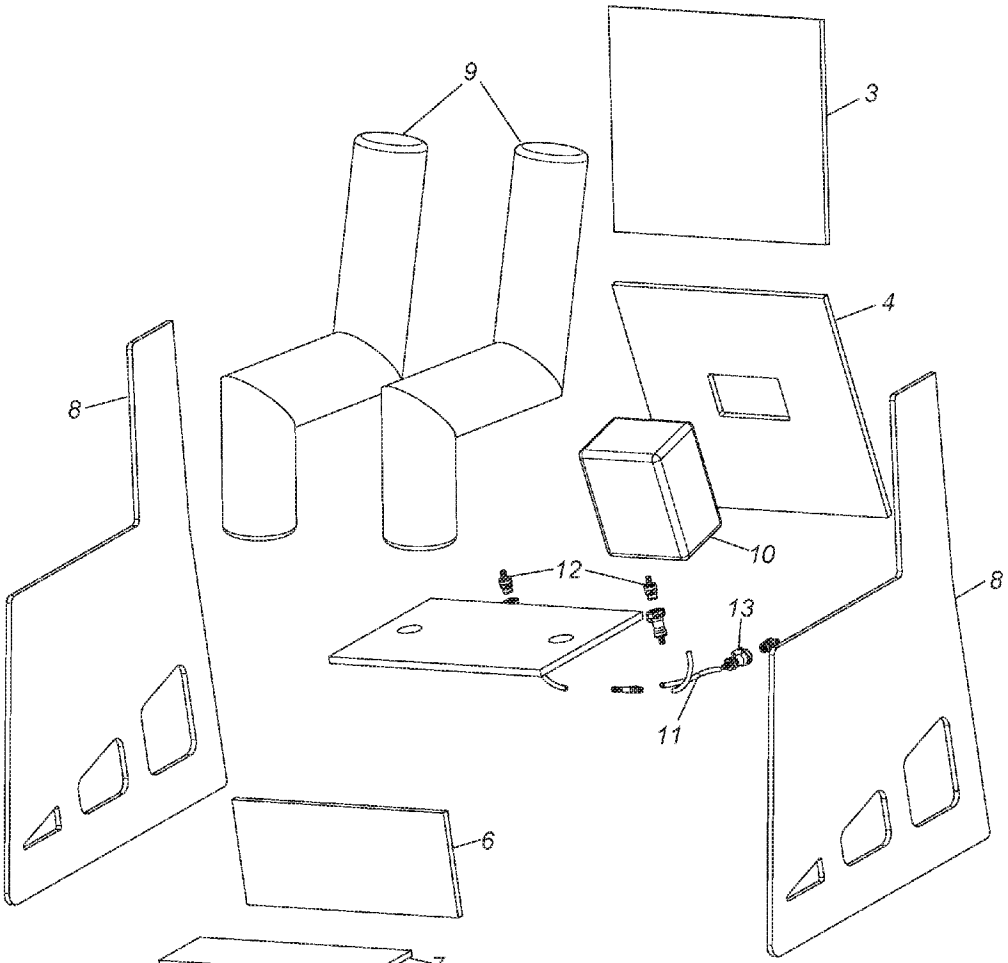
FIG. 4 is yet another isometric exploded view thereof.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Sensory Upright Chair 1

As shown in the Figures, the present invention is a sensory upright chair 1 which generally includes a box frame 2 constructed from at least a rear upper wall 3, a rear lower wall 4, a seat platform 5, a front wall 6, a front step 7 and a pair of sidewalls 8. A pair of air tubes 9 are set upon the seat platform 5. The pump 15, pressure sensor 16 and pressure relief valve 17 are contained within an enclosure 10. The pump 15 is connected to the air tubes 9 via air hoses 11. Apertures 18 located in the seat platform 5 allow the hoses 11 to connect directly to the air tubes 6.

Figure 5:
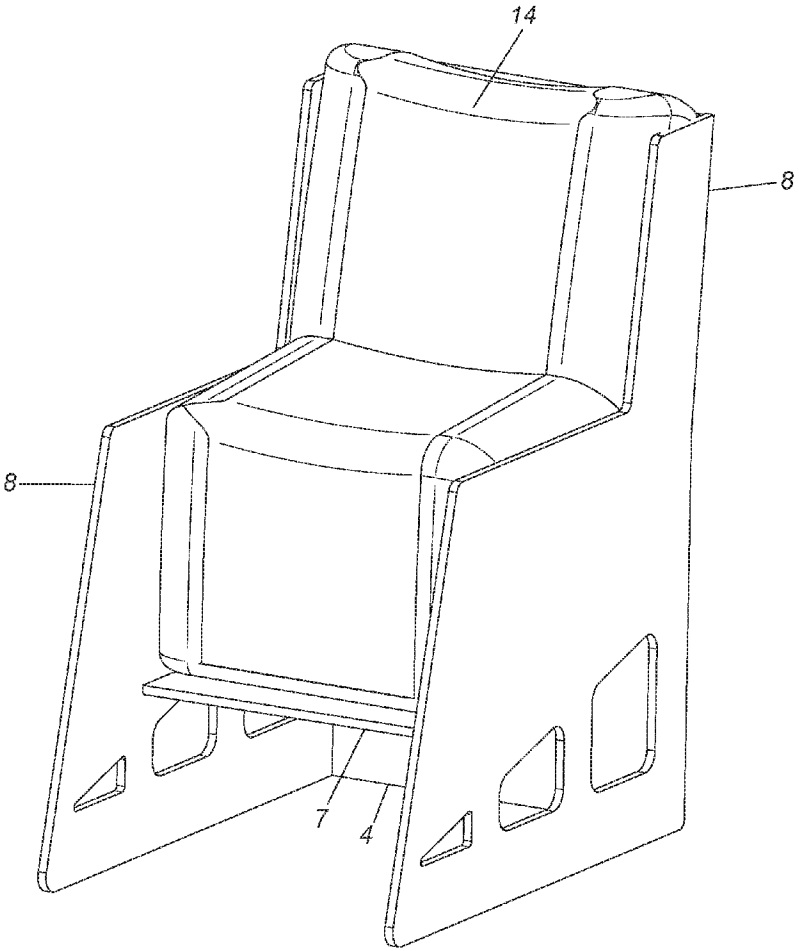
FIG. 5 is an isometric view thereof including a fabric cover.

The hoses 11 include connectors 12 for connecting or disconnecting from the air tubes as necessary and connector 13 for connecting or disconnecting to the pump system inside the enclosure 10. The enclosure 10 is attached to the rear lower wall 4. A cover 14 (seen in FIG. 5) made of a flexible material covers the air tubes 6. The cover 14 is made of a user-friendly fabric that is removable and washable. Zippers, press studs, elasticated material or other connecting elements may alternatively be used to secure the cover to the box frame 2. The cover will flex to accommodate the air tubes 9 as they inflate.

The pump 15, pressure sensor 16 and relief valve 17 system preferably is operated using a set of controls 19 on the enclosure attached to the rear lower wall 4. Alternatively the pump, pressure sensor and relief valve system can be controlled via a remote control, either wired to the control box or operated wirelessly.

The sensory upright chair 1 is used by placing the occupant between the air tubes and then inflating the air tubes such that they provide sufficient deep touch pressure to the occupant.

A alternative embodiment mechanical version of the pump and pressure sensor system may be provided by replacing the electrical powered pump with a mechanical pump such as a bellows foot pump or hand pump (not shown), and by replacing the pressure sensor with a pressure limiting valve, with an adjustable set-point. This set-point is set to a pressure point similar to the upper pre-set limit in the electrical version of this system. In the mechanical version the mechanical pump is used to inflate the tubes, and the pressure can be increased until it reaches the set-point of the pressure limiting valve.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A sensory upright chair system comprising:

a box frame comprising two side boards, a rear upper board, a rear lower board, a seat platform, a front board, and a front step;

a pair of inflatable air tubes placed within said box frame and on top of said seat platform, each of said inflatable air tubes comprising a top end, a middle section and a bottom end;

said inflatable air tubes oriented such that inflatable air tube connectors fit through apertures in said seat platform, each respective inflatable air tube having a top end adjacent to said rear upper board, and each-respective inflatable air tube having a bottom end adjacent to said front board;

an enclosure attached to said rear lower board containing an air pump, a pressure sensor configured to regulate and report air pressure, and a pressure release valve;

controls connected to said air pump, said pressure sensor, and said pressure release valve;

at least two air hoses connected to said air pump, wherein each of said pair of inflatable air tubes is connected to at least one of said at least two air hoses, such that each inflatable air tube is connected to at least one air hose; and wherein said inflatable air tubes are configured to provide deep touch pressure to any object placed between said pair of inflatable air tubes.

2. The system of claim 1, further comprising:

each of said at least two air hoses comprising respective connectors.

3. The system of claim 1, wherein said air pump comprises a pump selected from the list comprising: an electrical powered pump, a bellows foot pump, and a hand pump.

4. The system of claim 1, further comprising:

said controls located within said enclosure, said controls configured to inflate said inflatable air tubes; and said controls further configured to deflate said inflatable air tubes.

5. The system of claim 4, wherein said enclosure further includes controls configured to set a maximum pressure of said inflatable air tubes.

6. The system of claim 1, further comprising a cover, said cover being placed over said pair of inflatable air tubes.

7. The system of claim 6, wherein said cover comprises a soft, flexible material configured to transfer pressure within said pair of inflatable air tubes to said object.

* * * * *